US009950838B2

(12) United States Patent
Bajuyo

(10) Patent No.: US 9,950,838 B2
(45) Date of Patent: Apr. 24, 2018

(54) HANDHELD FLUID CONTAINER

(71) Applicant: Antonio Bajuyo, South Bend, IN (US)

(72) Inventor: Antonio Bajuyo, South Bend, IN (US)

( * ) Notice: Subject to any disclaimer, the term of this patent is extended or adjusted under 35 U.S.C. 154(b) by 0 days.

(21) Appl. No.: 15/042,128

(22) Filed: Feb. 11, 2016

(65) Prior Publication Data

US 2016/0229591 A1 Aug. 11, 2016

Related U.S. Application Data

(60) Provisional application No. 62/176,204, filed on Feb. 11, 2015.

(51) Int. Cl.
*B65D 1/14* (2006.01)
*B65D 25/28* (2006.01)
*B65D 25/00* (2006.01)

(52) U.S. Cl.
CPC ..... *B65D 25/282* (2013.01); *B65D 1/14* (2013.01); *B65D 25/00* (2013.01); *B65D 25/2888* (2013.01)

(58) Field of Classification Search
CPC .... B65D 25/282; B65D 25/2888; B65D 1/14; B65D 25/30; B65D 25/2882; B65D 25/2867; B65D 25/2805; B65D 25/2808
USPC ..... 220/507, 608, 603
See application file for complete search history.

(56) References Cited

U.S. PATENT DOCUMENTS 3,405,858 A * 10/1968 Collie ..... B65D 81/36 220/608
3,690,507 A * 9/1972 Gailus ..... B65D 7/04 220/606
4,878,593 A * 11/1989 Rausing ..... B65D 25/2888 220/566
6,419,106 B1 * 7/2002 Bebak ..... B44D 3/121 220/570
6,769,136 B1 * 8/2004 Martelly ..... A41D 13/0012 2/51
6,827,233 B1 * 12/2004 Scallate ..... B44D 3/125 220/603
7,959,030 B2 * 6/2011 Bergman ..... B44D 3/126 220/570
2002/0005409 A1 * 1/2002 Rosa ..... B05C 17/0245 220/570
2002/0033397 A1 * 3/2002 Henson ..... A63H 15/06 220/603

* cited by examiner

*Primary Examiner* — Stephen Castellano
(74) *Attorney, Agent, or Firm* — R. Tracy Crump

(57) ABSTRACT

A handheld fluid container shaped and configured so that the majority of the fluid volume is carried near the rear of the container where the container is held and supported. In various embodiments, the containers have handle parts and/or handle openings that allow the containers to be manually supported from the rear of the containers. The container bodies also have forward angled front and rear walls and container bottoms shaped so that the majority of the interior volume of the container is located at the rear of the container rather than at the front. The center of gravity of the containers when partially or fully filled with fluid is located near the rear of the container where it is manually supported by the user.

16 Claims, 17 Drawing Sheets

HANDHELD FLUID CONTAINER

This application claims the benefit of U.S. Provisional Application No. 62/176,204 filed Feb. 11, 2015, the disclosure of which is hereby incorporated by reference.

This invention relates to fluid containers and has specific relevance to handheld fluid containers.

BACKGROUND OF INVENTION

Handheld fluid containers, such as pails, buckets, paint cans and the like, are used in a variety of applications and generally well known in such arts. Often, handheld fluid containers have wire bails or types of grip handles. Wire bails are convenient for carrying or toting the fluid containers, but often cumbersome for one handed support of the containers while conveniently accessing the contents of the containers. Effort must be made to twist the bail away from the center, or the container must be grasped by a side wall or bottom.

In many applications, such as painting, handheld fluid containers, i.e paint cans and pails, must be supported with one hand while the other hand accesses the contents of the container. Painting often involves holding with one hand a paint container for extended periods of time while the other hand holds a paint brush or paint roller. When conventional fluid containers, such as paint cans and pails are held unconventionally, i.e. not held simply by the container hanging from the held bail, the weight of the filled container naturally exerts force on the supporting hand and wrist. When held other than over the container's center of gravity, the weight of the container and its contents is unbalanced and creates a torque that is born by the user's hand and wrist. While holding fluid containers in such manners is often ideal for its particular use, the unbalanced weight of the fluid container is often uncomfortable for the user and leads to fatigue and injury over time and repetitive use.

SUMMARY OF INVENTION

The handheld fluid containers of this invention provide an ergonomically improved container that reduces hand and wrist fatigue from supporting the unbalanced weight of the fluids carried in the containers. The handheld fluid containers embodying this invention are shaped and configured so that the majority of the fluid volume is carried near the rear of the container where a container is held and supported by a user. In each embodiment, the containers have handle parts and/or handle openings that allow the containers to be manually supported from the rear of the containers. The container bodies also have forward angled front and rear walls and container bottoms shaped so that the majority of the interior volume of the container is located at the rear of the container rather than at the front. As such, the center of gravity of the containers when partially or fully filled with fluid is located near the rear of the container where it is manually supported by the user. Locating the center of gravity of the container rearward helps reduce torque exerted on the user's hand, which reduces stress and fatigue as the container is manually held and supported by a user.

In each embodiment of the handheld fluid containers of this invention, the front and rear walls of the containers are angled forward. In certain embodiments, the container bottom has a semielliptical or trapezoidal shape where the rear wall is wider than the front wall, so that the majority of the interior volume is located at the rear of the container. In other embodiments, the container bottom has a raised floor area, which also contributes to decreasing the interior volume of the container near its front and shifting the container's center of gravity toward the rear of the container. The raised floor area of the container bottom helps reduce the interior volume at the front of the containers. The fluid containers in their various embodiments also have a handle part and/or top opening which allows the user to hold and support the container at its rear to provide ready access to the container's contents. The handle parts and openings are generally positioned at the top and rear of the containers and shaped to provide improved ergonomics to the containers.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

Figure 1:
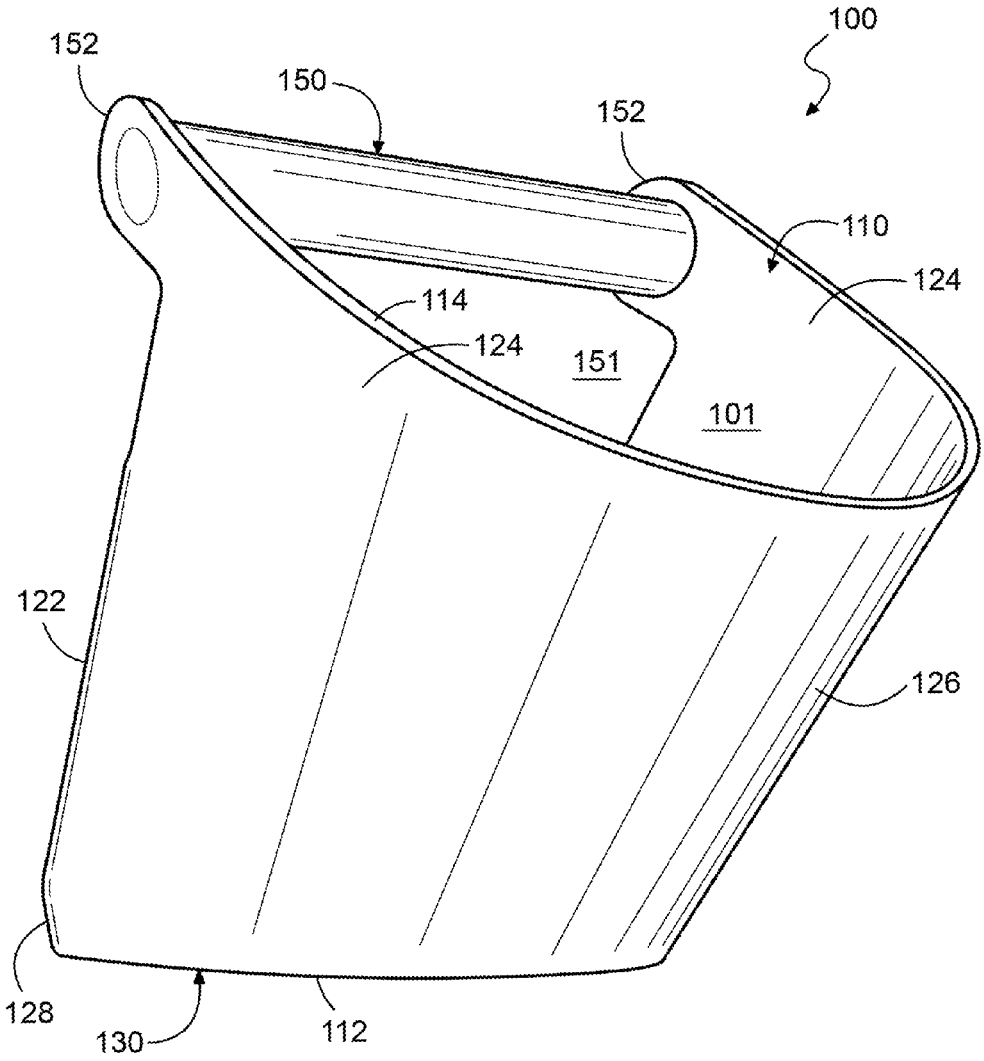
FIG. 1 is a perspective view of an exemplary embodiment of a fluid container of this invention.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, several different but exemplary embodiments of the fluid container of this invention are illustrated. As used generally herein pertaining to the various embodiments of the fluid container of this invention, the terms "front" and "rear" refer to the locations along the coordinate direction X, the terms "top" and "bottom" relate to positions or locations of the container along the coordinate direction Y, and the terms "sides" or "left" and "right" refer to positions or locations of the container along the coordinate direction Z, where the coordinate directions X, Y and Z are each perpendicular to each other in a Cartesian coordinate system.

The fluid containers of this invention are generally open top "bucket" type containers designed and intended to be manually carried and supported by a user with one hand at the rear of the container. Moreover, each embodiment of the fluid containers are shaped and configured so that the majority of the fluid volume is carried at the rear of the container near its handle and where a user may grasp the container. As such, the center of gravity of the container when partially or fully filled with fluid is located near the rear of the container where it is manually supported by the user. The configuration and geometry of the container is specifically selected to shift the center of gravity of the container to reduce user fatigue as the container is manually held and supported by a user.

Each embodiment of the containers of this invention may be cast or molded from a variety of materials, such as plastics and metals, using conventional manufacturing techniques. The particular materials from which the containers are constructed are selected as appropriate based on the container's intended fluid contents and application. The bodies of the containers are formed to provide sufficient structural rigidity so that the container walls and bottoms can support the volume of the container therein, without deforming during use or while being manually carried and supported. The containers of this invention may be used in a variety of applications, but are particularly well suited for use as a paint container. The containers allow a painter to comfortably hold and support the container in one hand, while dipping a brush or roller into the container with the other hand.

FIGS. 1-7, 9 and 10 illustrate an exemplary embodiment of the fluid container of this invention, which is designated generally as reference numeral 100. As shown, fluid container 100 includes a container body that defines an interior 101 with an open top for holding fluids. The container body has an enclosed container wall 110 and an integral container bottom 130. As shown best in FIG. 3, container bottom 130 has a generally "semielliptical" planer shape. Container wall 110 extends around the periphery of container bottom 130 and has a flat rear wall portion 122, and opposed side wall portions 124 and a rounded front wall portion 126. The left and right side wall portions 124 transition from back wall portion 122 and converge into rounded front wall portion 126. Container walls 110 also have a lower rear wall portion 128 that transitions from the back wall 122 into the container bottom 130. Container wall 110 has a peripheral bottom edge 112 and a peripheral top edge 114. Container bottom edge 112 extends circumferentially around the bottom of container 100. Container bottom edge 112 also provides the contact surface, upon which the container rests in an upright position when filled and placed on a horizontal surface. Top peripheral edge 114 extends around container wall 110 and defines the rim of container 100. Container bottom 130 has a flat bottom wall 132 at the rear of fluid container 100 that is aligned with and transitions from bottom edge 112 and back wall bottom portion 128. Container bottom 130 has a raised floor area 140 formed by bottom wall portions 142, 144 146, and 148 that defines an open exterior bottom cavity 141. Raised floor area 140 of bottom wall 130 may act as a brush support surface. Raised floor area 140 acts as a brush bristle resting point utilizing a surface that angles toward the rear wall portion 122. In other embodiments, the raised floor area may act as a paint roller surface.

Container 100 also includes a handle 150. Handle 150 is ideally formed or molded as an integral part of the container, but may be a separate piece attachable thereto. As a separate piece, handle 150 may be made of plastic, wood, metal, or other rigid material or formed as a flexible rod or strap member of elastomeric rubber or silicone, either entirely or partly. Handle 150 may also be ergonomically shaped to allow for the ease of support, balance and manipulation of the container as desired for its intended purpose.

Handle 150 extends laterally between two opposed side protrusions or "ears" 128 that integrally extend rearward from side wall portions 124. Handle 150 may be fixed to side protrusions 128 or may be rotatably attached between the protrusions as desired. As shown, handle 150 extends above and rearward of rear wall portion 122. Rear wall 122 has a top edge 116 that is spaced below the plane of top edge 114 and handle 150 to form a handle opening 151 through which a user's fingers and thumb extend when carrying or supporting fluid container 100.

Figure 2:
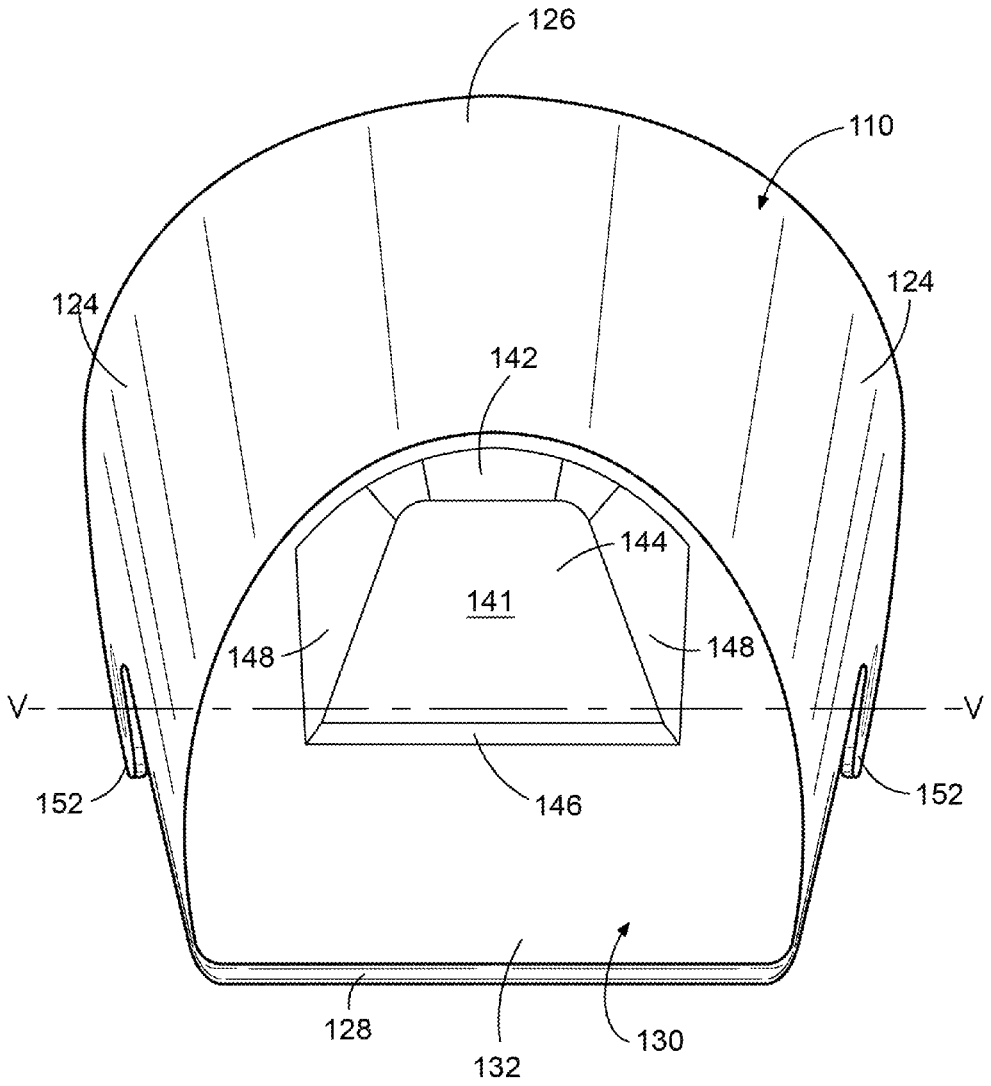
FIG. 2 is a bottom view of the fluid container of FIG. 1.
Figure 3:
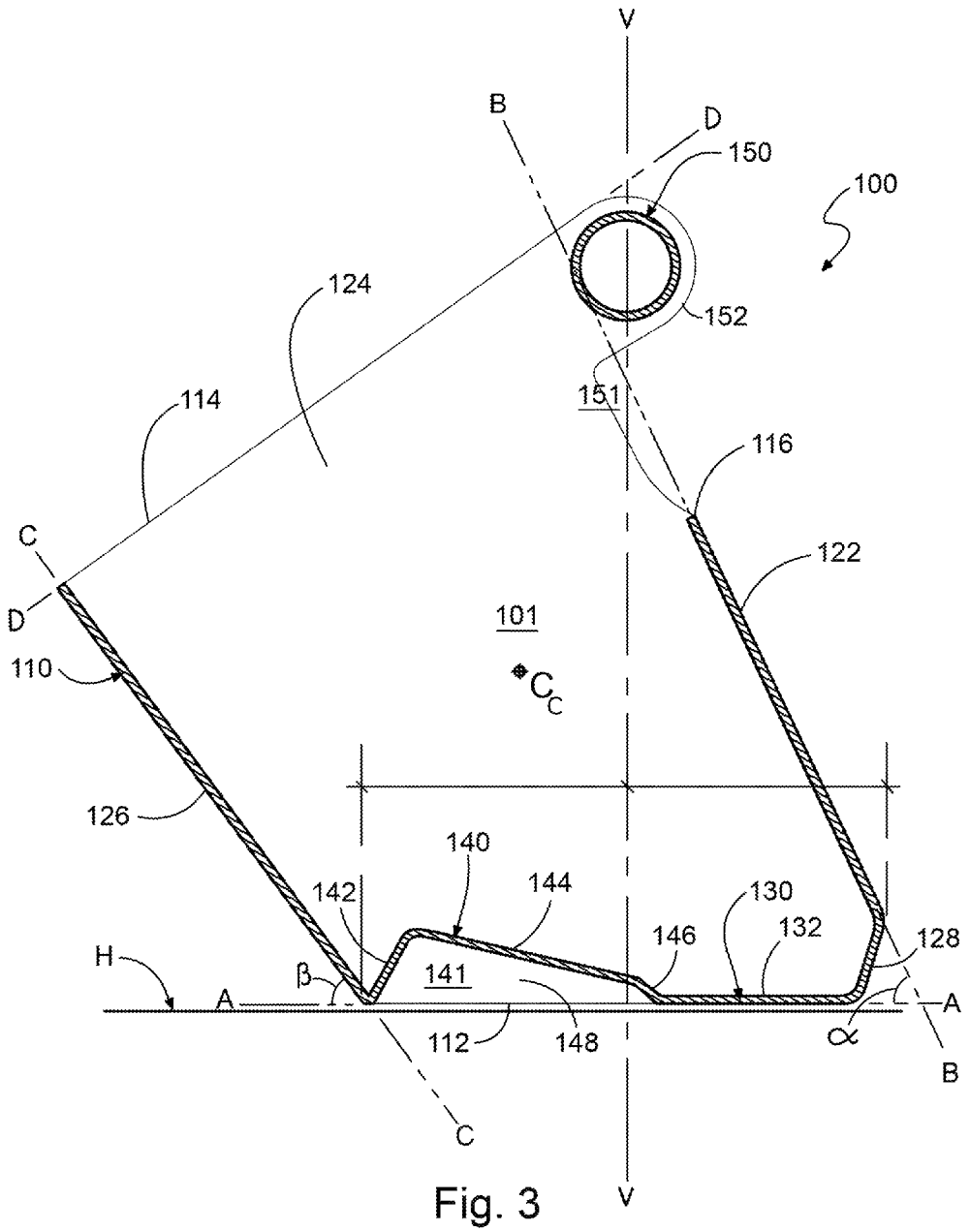
FIG. 3 is a side sectional view of the fluid container of FIG. 1 resting on a horizontal surface.

FIGS. 3-7 illustrate how fluid container 100 is shaped and configured so that the majority of the fluid volume is carried at the rear of the container near its handle and where a user may grasp the container. As shown in FIG. 2, container bottom 130 has a generally semielliptical shape with the rear of the container bisecting the ellipse across its minor axis. The semielliptical shape of container bottom 130 and angular configuration of the front and rear wall portions 122 and 126 provide container interior 101 with a geometry where the majority of the interior volume of the container is located at its rear rather than at its front. As shown in FIG. 3, container bottom edge 112 lies in a plane A-A. Container bottom wall 132 also lies in plane A-A of bottom edge 112 at the rear of the container 100. Container top edge 114 lies in a plane D-D, which is generally perpendicular to plane B-B. Handle 150 is positioned below the plane D-D of container top edge 114 and rearward of the plane C-C past rear wall portion 122. Raised floor area 130 is spaced above the plane A-A at the front of Container 100. Container wall rear portion 122 lies in a plane B-B, which intersects plane A-A at an acute angle $\alpha$ (generally 50-85°). Container wall front portion 126 is tangent to a plane C-C, which intersects plane A-A at an acute angle $\beta$ (generally 40-80°). Consequently, front wall portion 126 angles forward and away from rear wall portion 122 and handle 150. Angle $\alpha$ is generally greater than angle $\beta$ by a few degrees. Fluid container 100 is also configured so that handle 150 is generally elevated above front wall portion 126 and rear wall portions 122 and generally centered over container bottom 130, whether resting on horizontal surface H or when suspended.

FIG. 3 illustrates fluid container 100 empty and resting on a horizontal surface G. As a hollow vessel, fluid container 100 has a centroid $C_c$, which is the geometric center of the container (the "arithmetic mean" or "average position" of all the points in the container in all coordinate directions). Centroid $C_c$ is also the center of gravity $CG_E$ for fluid container 100 when empty. When resting on horizontal surface H, regardless of whether empty, partially filled or fully filled with a fluid 10, container 100 is stable with centroid Cc and center of gravity CG is situated over container bottom 130 between rear wall portion 122 and front wall portion 126. As such, fluid container 100 is balanced and relatively difficult to be tipped over when resting on a horizontal surface.

Figure 4:
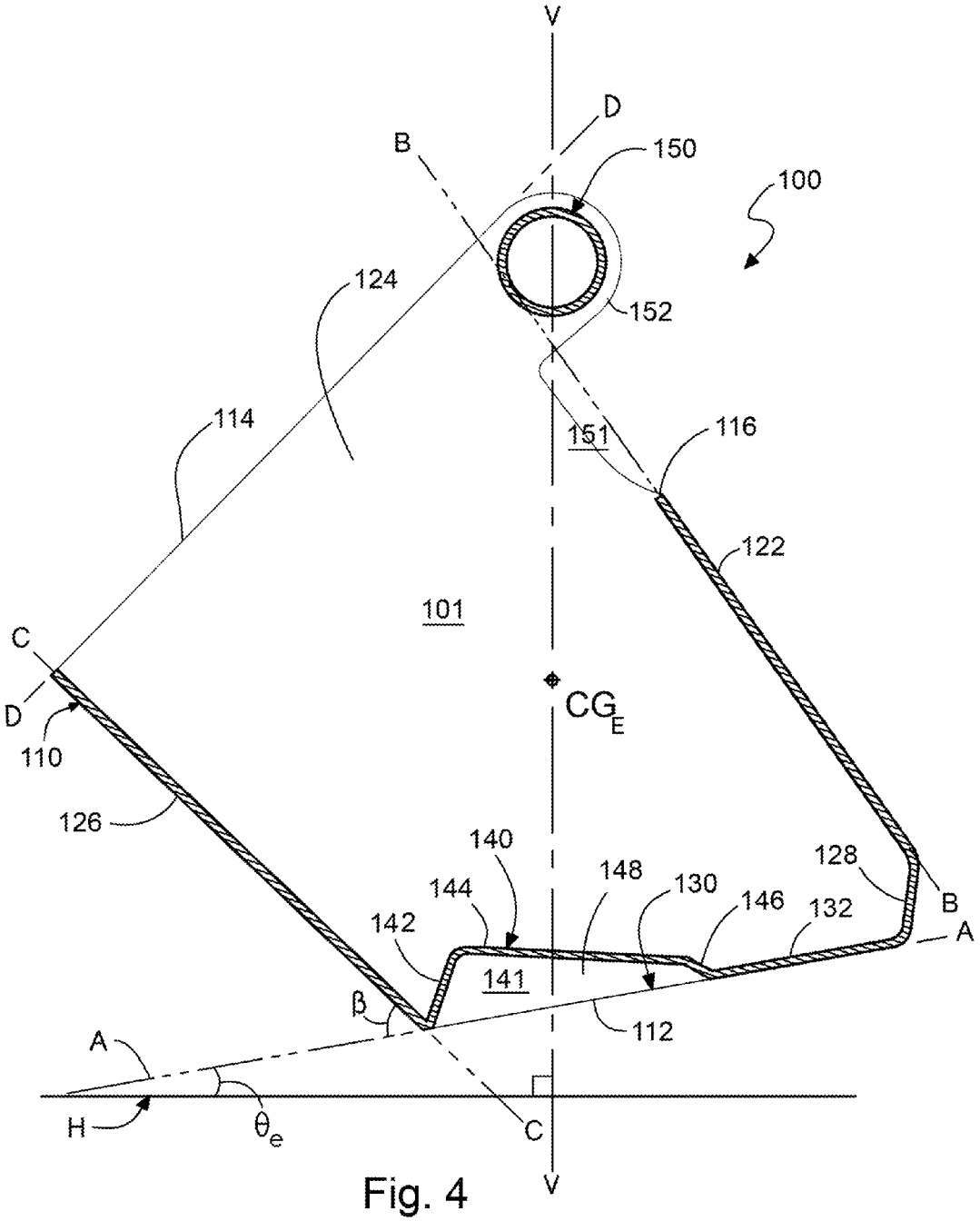
FIG. 4 is a side sectional view of the fluid container of FIG. 1 suspended over a horizontal surface when empty.

FIG. 4 illustrates an empty fluid container 100 suspended above horizontal surface H and supported about handle 150. As shown, an empty suspended fluid container 100 pivots so that the centroid $C_c$ (center of gravity $CG_e$) lies in a vertical plane aligned with the axis of rotation of handle 150. When empty and suspended about handle 150, the front of fluid container 100 pivots downward so that plane A-A is at an angle $\theta_e$ (approximately) 2-15°) with respect to horizontal surface H.

Figure 5:
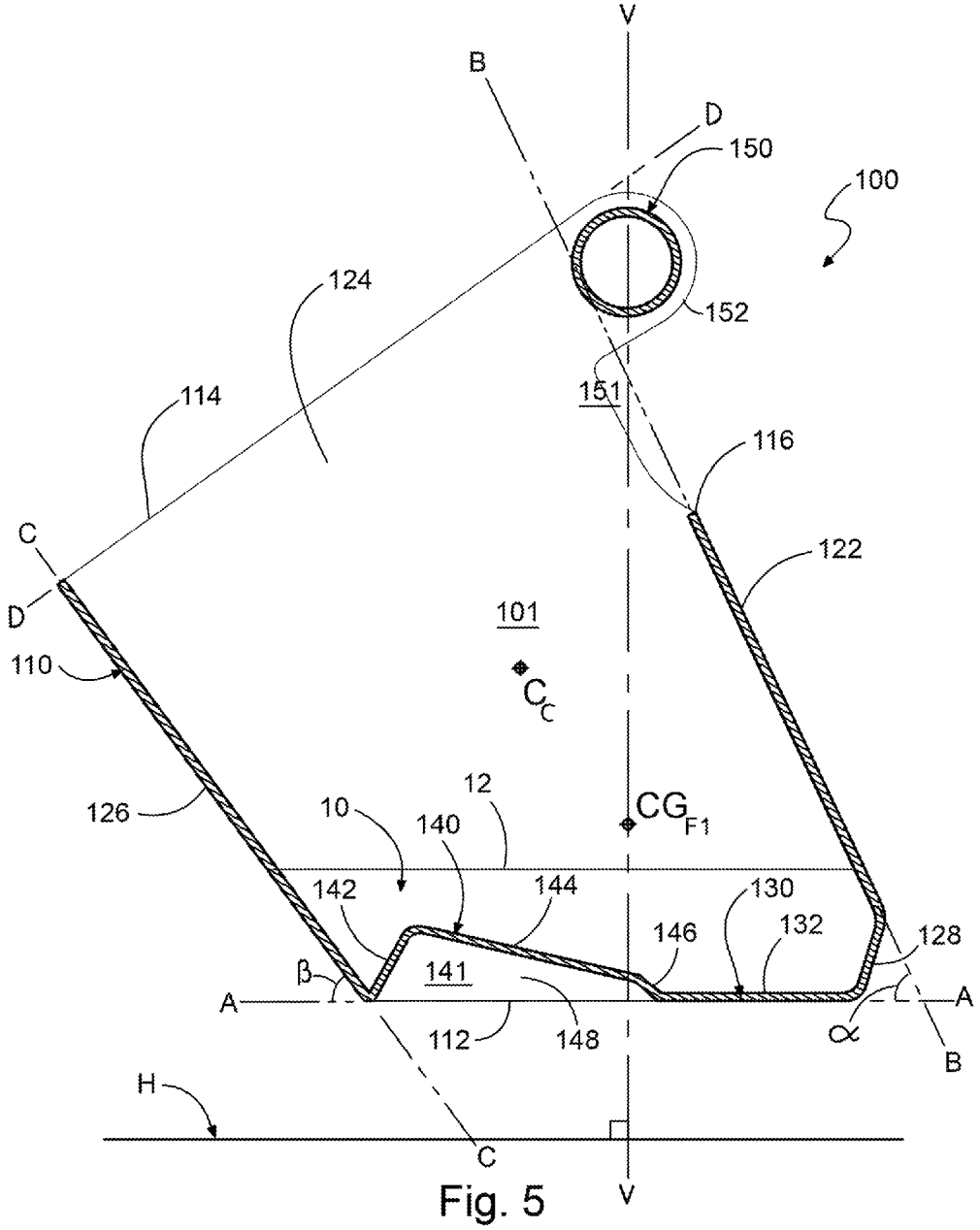
FIG. 5 is a side sectional view of the fluid container of FIG. 1 suspended over a horizontal surface and partially filled with a fluid.
Figure 6:
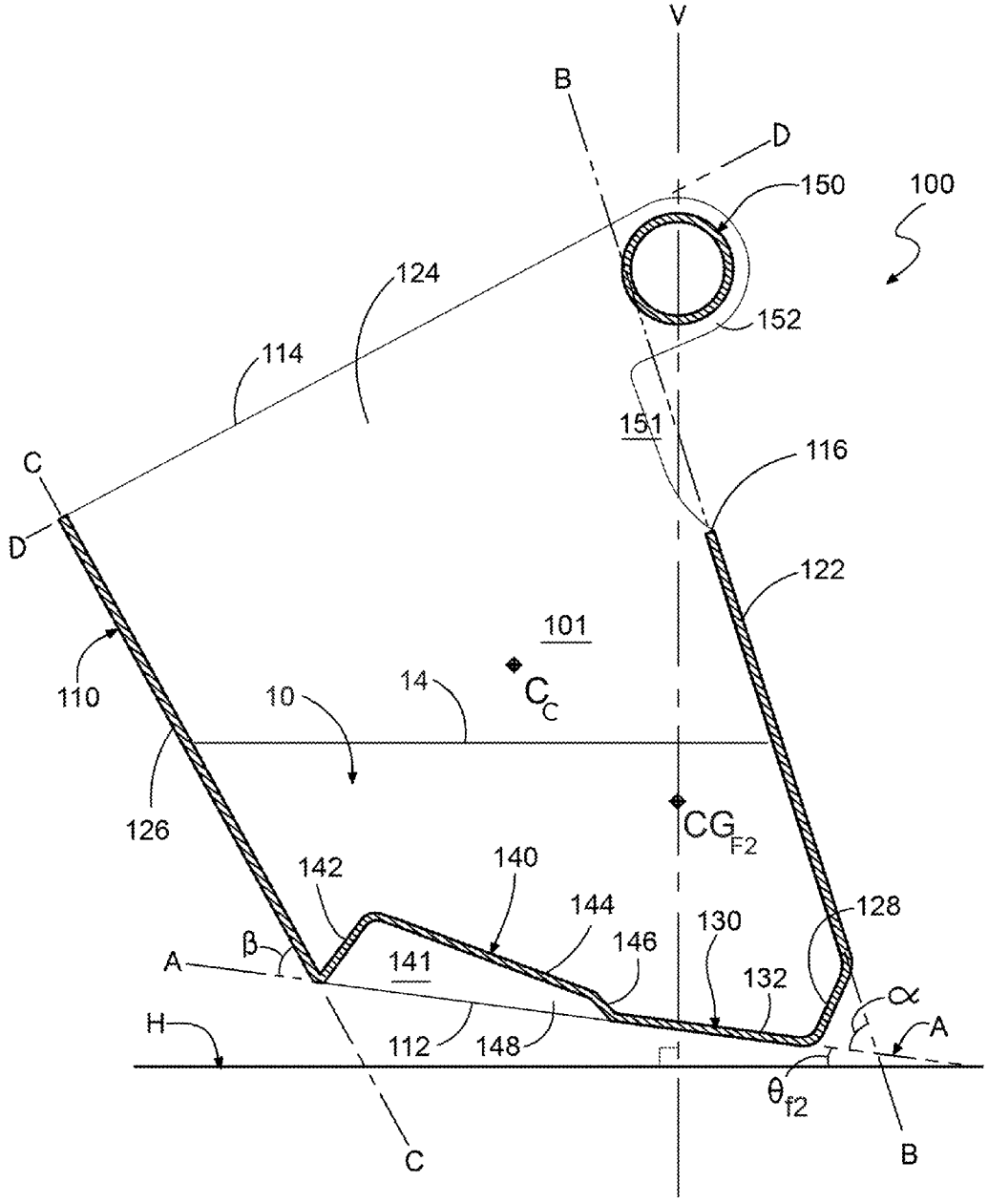
FIG. 6 is another side sectional view of the fluid container of FIG. 1 suspended over a horizontal surface and partially filled with a fluid.

FIGS. 5 and 6 illustrate fluid container 100 when filled with fluid 10 to various fill lines and supported about handle 150 suspended above horizontal surface H. Generally speaking, any fluid for which fluid container 100 may be used has a higher density than the air that fills the container interior when empty. Consequently, any volume of fluid within container interior 101 shifts the center of gravity of the container and its contents rearward from centroid $C_c$ toward container rear wall 122. As such, the center of gravity of the container when partially or fully filled with fluid is located near the rear of the container where its is manually supported by the user.

FIG. 5 illustrates fluid container 100 filled with a fluid 10 to a fill line 12 that is suspended above horizontal surface H and supported about handle 150. Center of gravity $CG_{F1}$ lies on vertical plane V and is shifted rearward from centroid Cc. It should be noted that when suspended and filled to fill line 12 for a fluid of a certain density, fluid container 100 will not pivot about the axis of rotation of handle 150, but will remain generally parallel to horizontal surface H. As such, the orientation of fluid container 100 remains the same when suspended as when resting on a horizontal surface.

FIG. 6 illustrates fluid container 100 filled with a fluid 10 to a fill line 14 and suspended above horizontal surface H about handle 150. Center of gravity $CG_{F2}$ again lies on vertical plane V but is shifted further rearward from centroid Cc. It should further be noted that when suspended and filled to fill line 14 for a fluid of a certain density, fluid container 100 pivots about the axis of rotation of handle 150 lifting the container front, so that plane A-A intersects horizontal surface H at an angle $\theta_{F2}$ (2-10°).

The shape and configuration of fluid container 100 is specifically selected to shift the center of gravity of the container toward the rear of the container to reduce user fatigue as the container is manually held and supported by a user. Due to the semielliptical shape of the container bottom 130 and angular container walls, container interior 101 holds more volume at the rear of the container than at the front. As shown in FIGS. 5 and 6, fluid container 100, regardless of the volume of fluid carried therein, has a center of gravity shifted rearward from the centroid toward the rear of the container and handle 150, thereby reducing the moment arm (distance between support hand and the center of gravity). Reducing the distance between the center of gravity and the support hand lessens the torque exerted on the user in supporting fluid container 100.

It should be noted that raised floor portion 140 also contributes to shifting the center of gravity of the container and its contents toward the rear of container 100. Raised floor portion 140 creates a cavity 141 under the container bottom 130, thereby also reducing the interior volume at the front of fluid container 100. Shifting the center of gravity rearward reduces the amount of force required by the hand and wrist to support and balance fluid container 100. Not only does balancing fluid container 100 reduce strain on the hand and wrist, but it makes it possible to have the container oriented in the substantially same position whether held by a handle or placed on the ground. Other embodiments of this invention may include raised floor portions in the container bottom that take different shapes and configurations while still contributing to reducing the interior volume at the front of the container. For example, an alternative container may include an inset central planar wall that extends downward at an angle from the front wall portion to the container bottom to provide a roller surface, while also reducing the internal volume at the front of the container to shift the container's center of gravity closer to the rear of the container.

Figure 7:
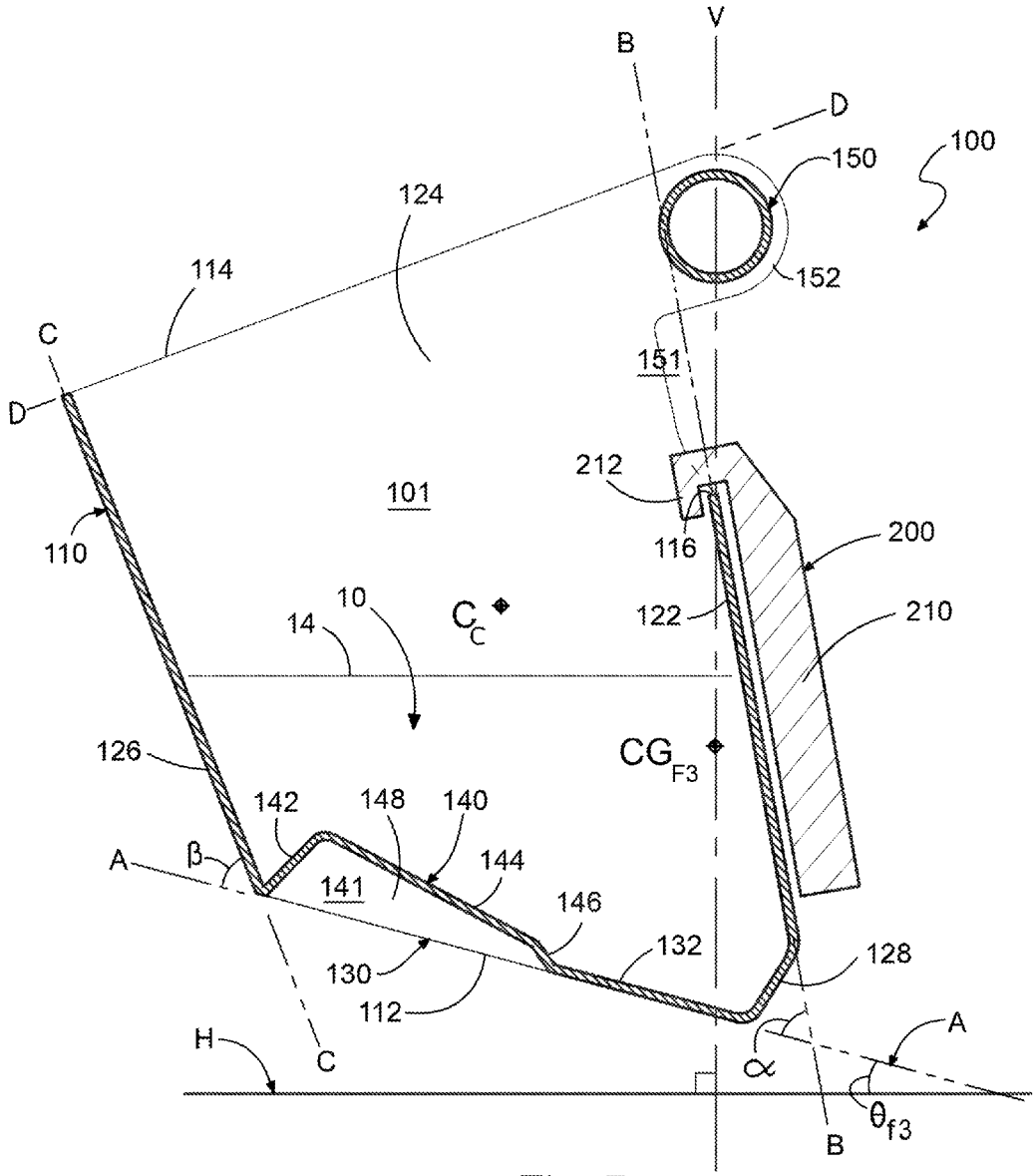
FIG. 7 is a side sectional view of the fluid container of FIG. 1 and an attached counter weight.

FIG. 7 illustrates a detachable counterweight 200 for use with fluid container 100. Counterweight 200 is constructed of a suitable material to add weight to the rear of fluid container 100. Counterweight 200 includes a flat body 210 and a hook part 212. Hook part 212 seats over top edge 116 of rear wall portion 122 to mount counterweight 200 to fluid container 100. Hook part 212 is fashioned to securely mate to rear wall portion 122 in a press-fit type connection, but may be connected to container wall 110 using any suitable securement mechanism as appropriate, including adhesives and fasteners. The shape and weight of counterweight 200 is selected to provide the desired shift in the container's center of gravity towards the rear of fluid container 100 when the suspended fluid container 300 is filled with fluid 10 to fill line 14. Adding counterweight 200 allows fluid container 100 to pivot about the axis of rotation of handle 150 lifting the front of the container, so that plane A-A intersects horizontal surface H at an angle $\theta_{f3}$ (2-10°).

Figure 8:
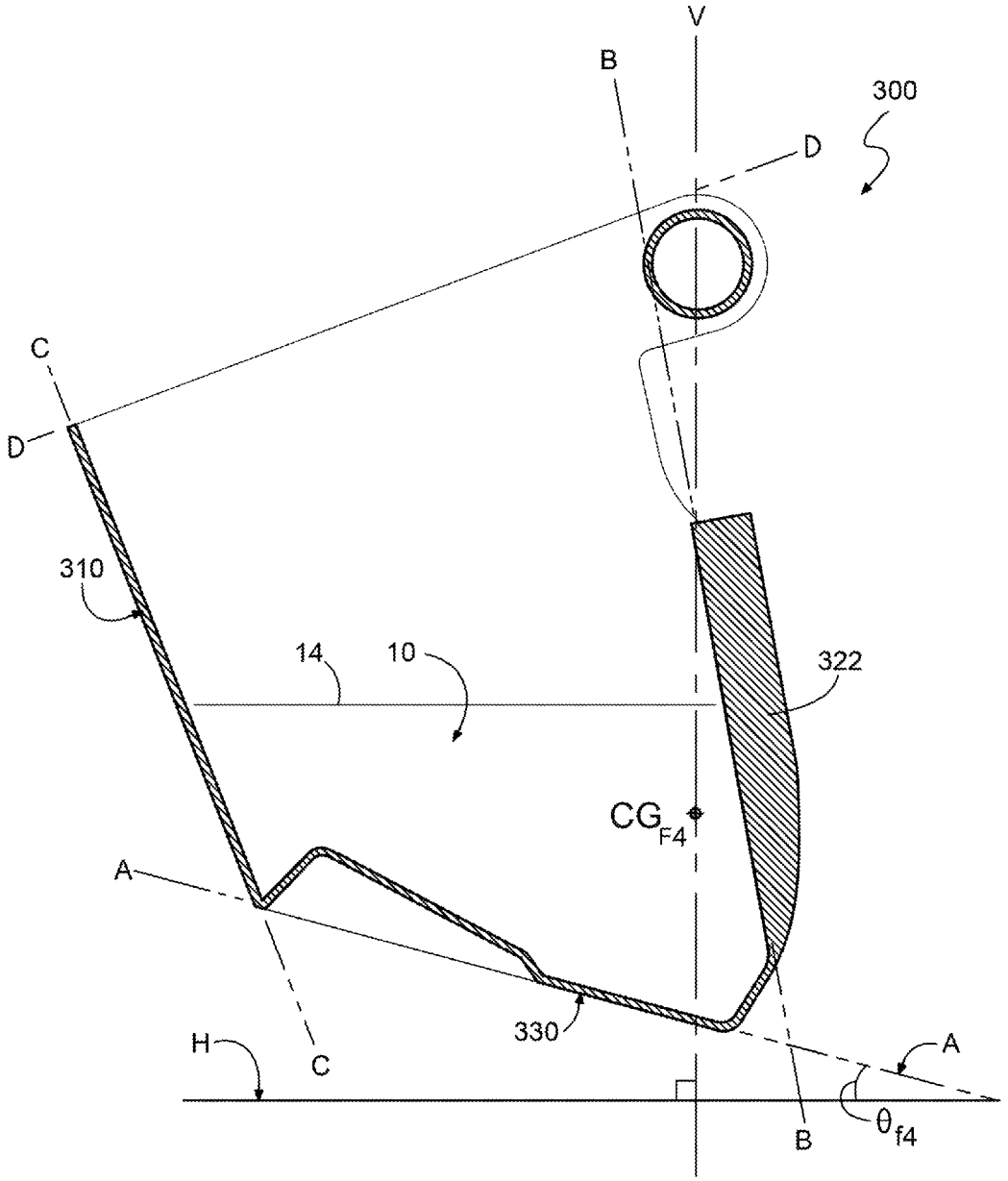
FIG. 8 is a side sectional view of an alternative second embodiment of the fluid container of this invention.

FIG. 8 illustrates another exemplary embodiment of the fluid container of the invention, which is designated as reference number 300. Container 300 is identical to fluid container 100 described above, except that the rear wall portion 322 is thicker to act as an integral counter weight. Rear wall portion 322 is ideally molded thicker than the other portions of container walls 310 and bottom wall 330. Denser materials and metals may be embedded within rear wall portion 322 to provide the desired mass to provide the counterweight action for fluid container 300. Again, the shape and weight of rear wall portion 322 is selected to provide the desired shift in the container's center of gravity $CG_{f4}$ towards the rear of fluid container 100 when the suspended fluid container 300 is filled with fluid 10 to fill line 16. Rear wall portion 322 allows fluid container 300 to pivot about the axis of rotation of handle 150 lifting the front of the container when supported about the handle, so that plane A-A intersects horizontal surface H at an angle $\theta_{f4}$ (2-10°).

Figure 9:
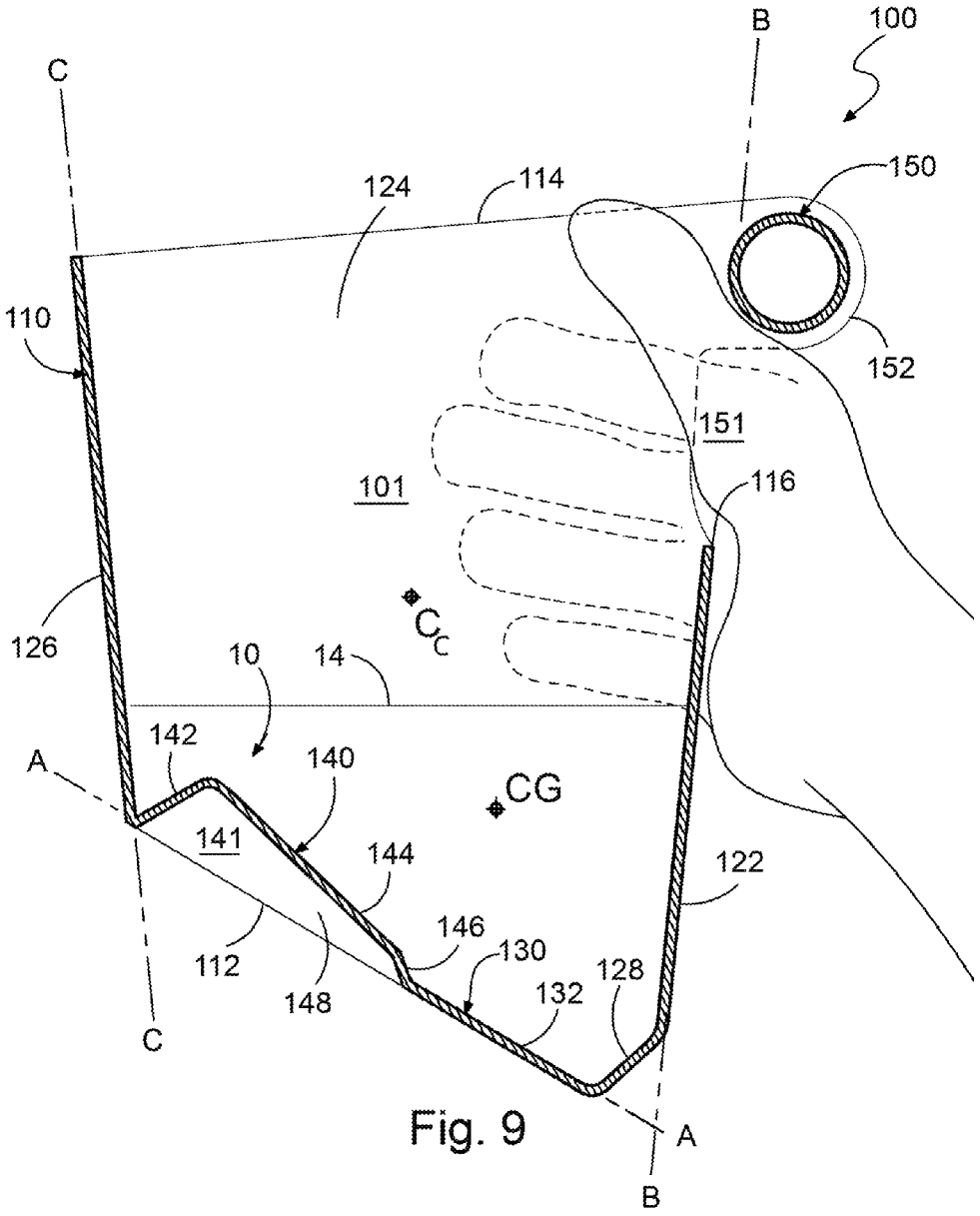
FIG. 9 is a side sectional view of the fluid container of FIG. 1 shown held by a user.

Fluid container 100 is designed to be held and supported with a single hand. In addition, the container is generally symmetrical along its longitudinal X axis (front to rear), so the container can be supported with either hand as desired. Fluid container 100 can be manually supported by a user grasping handle 150 in the same manner as a bail. FIG. 9 illustrates an alternative manner for holding and supporting container 100 where the user inserts the thumb through handle opening 151 into the container interior 101 as the fingers wrap around the side wall portion 124 and the back wall portion 122 abuts the palm. When held in this manner, the user's hand supports fluid container 100 in a natural position similar to that used in a handshake. Again, as discussed above, fluid container 100 is shaped and configured so that the majority of the fluid volume is carried at the rear of the container where a user's hand supports the container in this manner.

Figure 10:
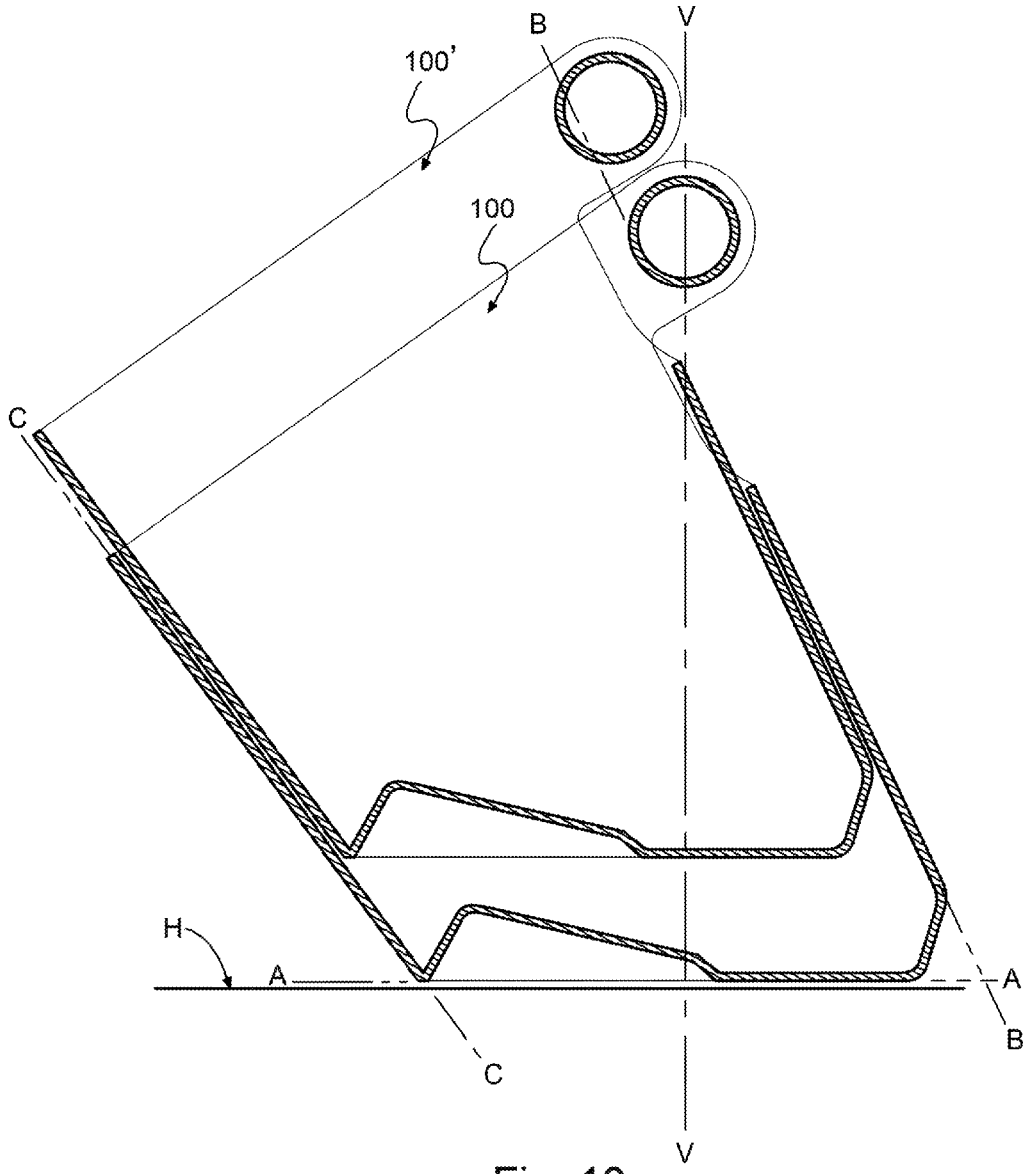
FIG. 10 is a side sectional view of two of the fluid containers of FIG. 1 shown nested together.
Figure 11:
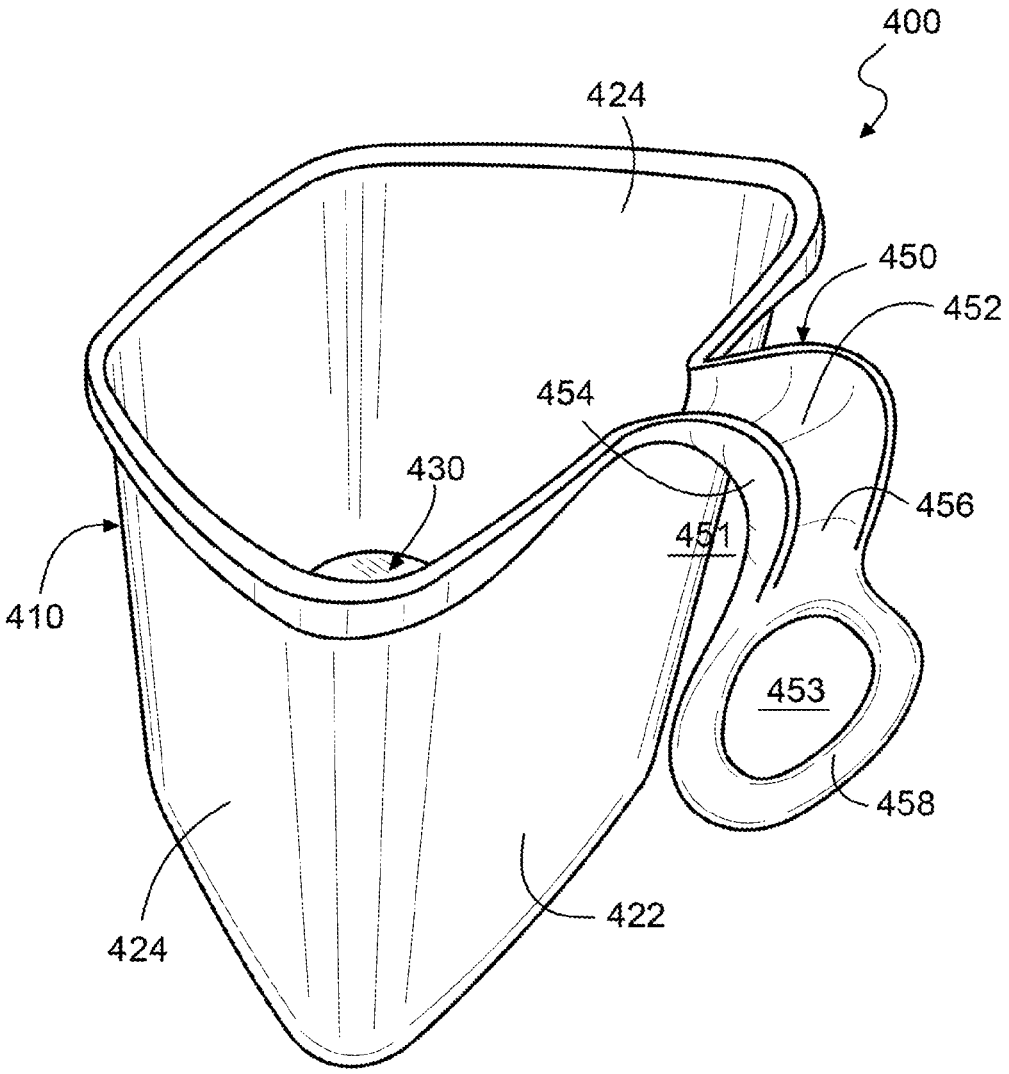
FIG. 11 is a perspective view of an alternative third embodiment of the fluid container of this invention.

As shown in FIG. 10, fluid containers 100 are shaped and configured to nest together for convenient storage and shelf display. Identical containers 100 and 100' nest together with the bottoms of one container seated within the interior of another. Fluid containers 100 are shaped so that approximately 75% of one container is disposed within the interior of another. As shown, fluid containers 100 stack at an angle when nested together due to the angular front wall portion and rear wall portions.

FIGS. 11-14 illustrate another exemplary embodiment of the fluid container of this invention, which is generally designated as reference numeral 400. Fluid container 400 is similar to fluid container 100 described above in construction and function, but has container walls 410 extending from a trapezoidal shaped container bottom 430. Container walls 410 having a flat rear wall 422, flat side wall 424 and a flat front wall 426. As shown, the rear wall 422 and front wall 426 are angled forward with respect to container bottom 430.

Figure 12:
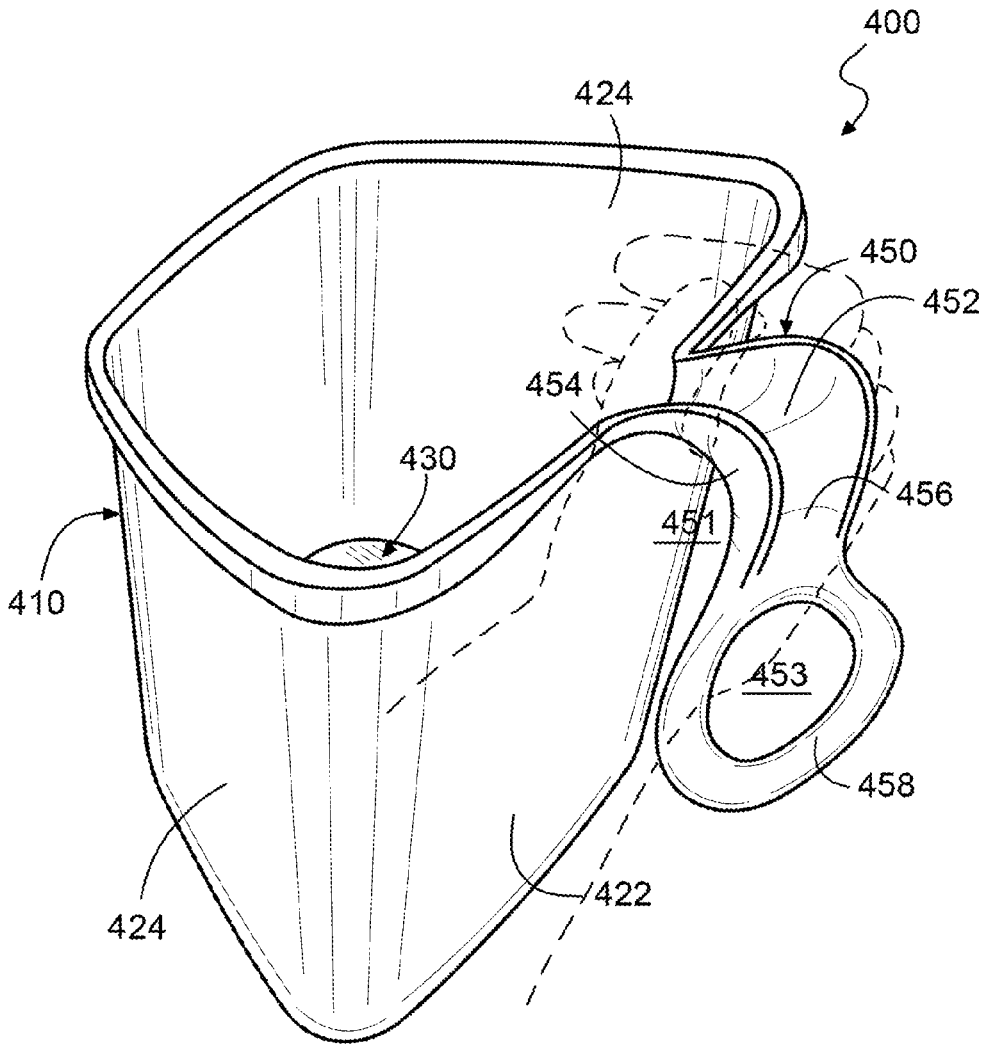
FIG. 12 is another perspective view of the fluid container of FIG. 11 showing the user supporting the container with the handle extending over the back of the hand.
Figure 13:
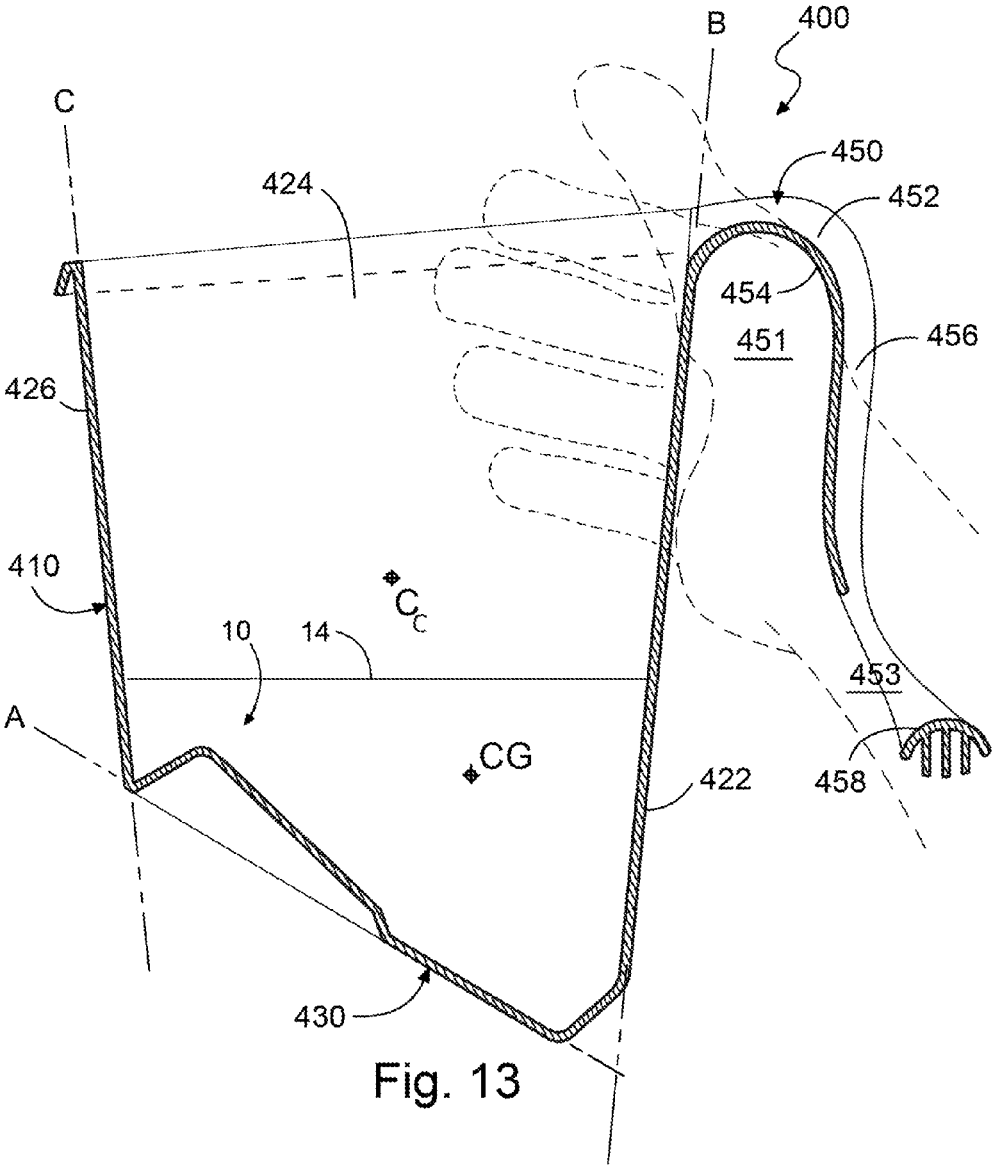
FIG. 13 is a side sectional view of the fluid container of FIG. 11 showing the user supporting the container with the handle extending over the back of the hand.
Figure 14:
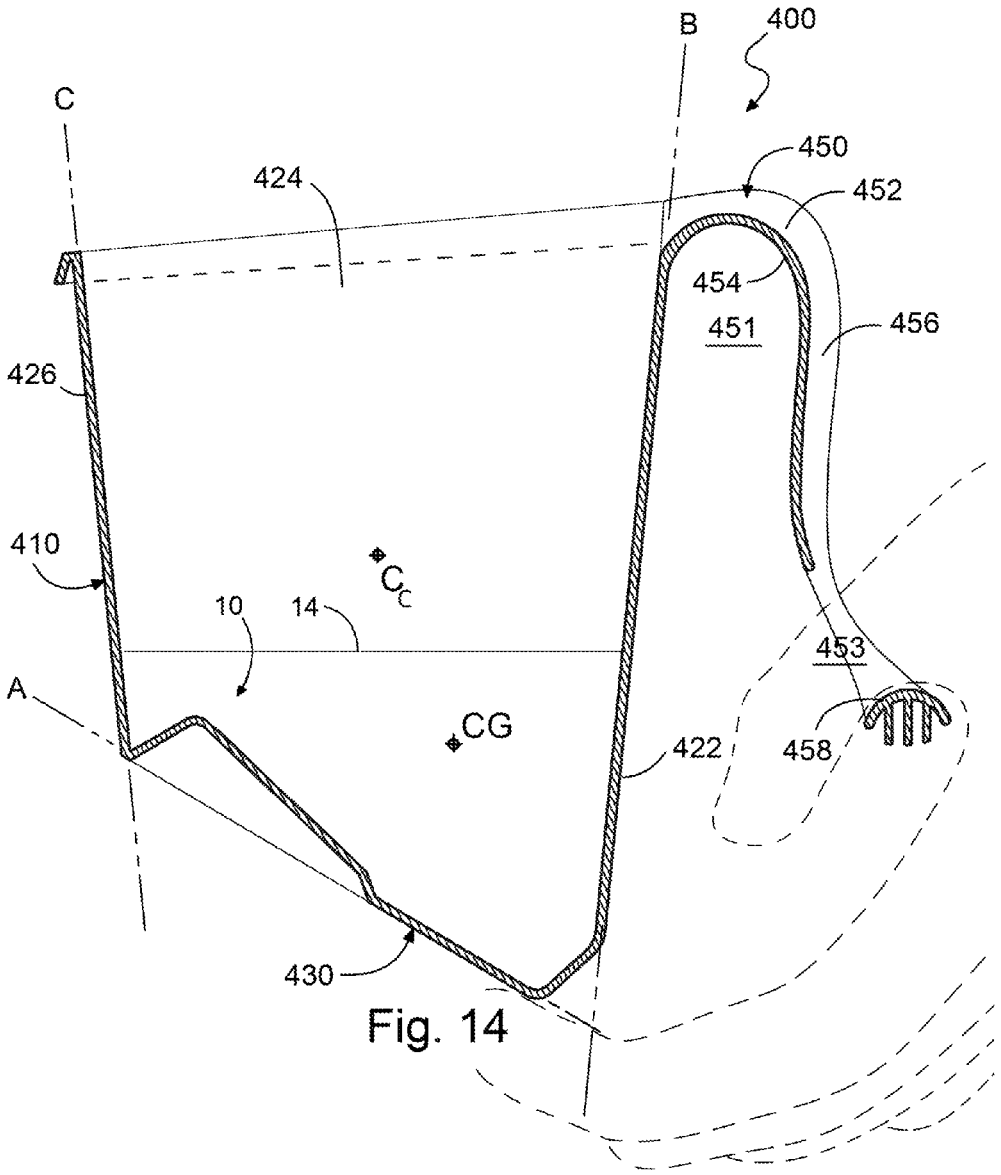
FIG. 14 is a side sectional view of the fluid container of FIG. 11 showing the user supporting the container with the thumb hooked through the handle loop and fingers supporting the bottom of the container.

Fluid container 400 also includes a "downward hook" handle 450. Handle 450 includes a downward curving handle body 452 integrally extending from the top of rear wall portion 422. Handle body 452 is spaced from rear wall portion 422 to define a handle opening 451. Handle body 452 also has a convex arcuate bottom surface 454 and a concave top surface 456. Bottom surface 454 is contoured to receive the user's hand when the hand is seated within handle opening 451 to support fluid container 400. The concave top surface 456 also provides structural rigidity to handle 450. Handle 450 terminates at its distal end in a loop 458 that defines a loop opening 453. Handle 450 is designed to allow fluid container 400 to ideally be grasped by placing the crook of the hand between the thumb and fingers under handle body 452 so that the palm of the hand supports rear wall 422 and the fingers wrapped around container side walls 424 with the thumb resting over the handle (FIGS. 12 and 13). Alternatively, a user can place the thumb through loop opening 453 while cradling the bottom of fluid container 400 with the fingers of the same hand from the rear of the container (FIG. 14).

Again, the shape and configuration of fluid container 100 is specifically selected to shift the center of gravity of the container toward the rear of the container to reduce user fatigue as the container is manually held and supported by a user. Due to the trapezoidal shape of the container bottom 130 and angular container walls, container interior 401 holds more volume at the rear of the container than at the front.

Figure 15:
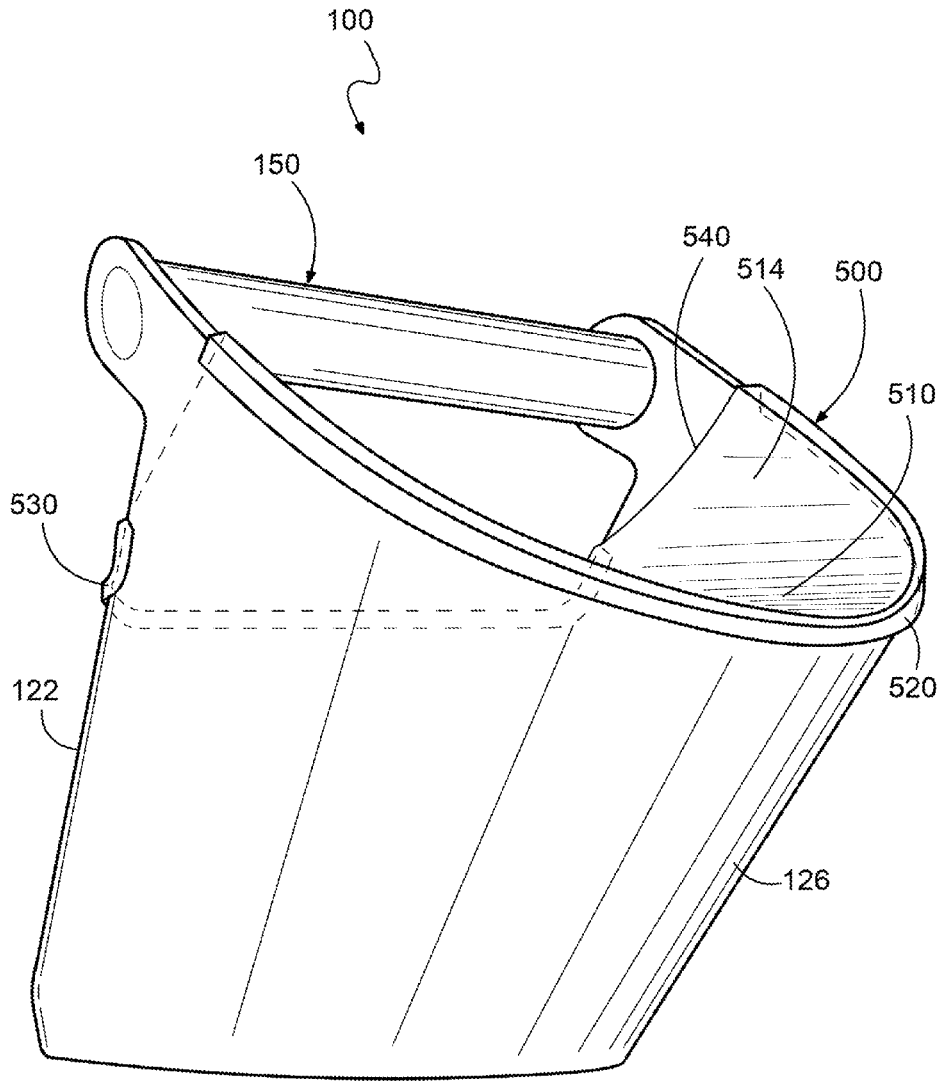
FIG. 15 is a perspective view of the fluid container of FIG. 1 and a removable lid.
Figure 16:
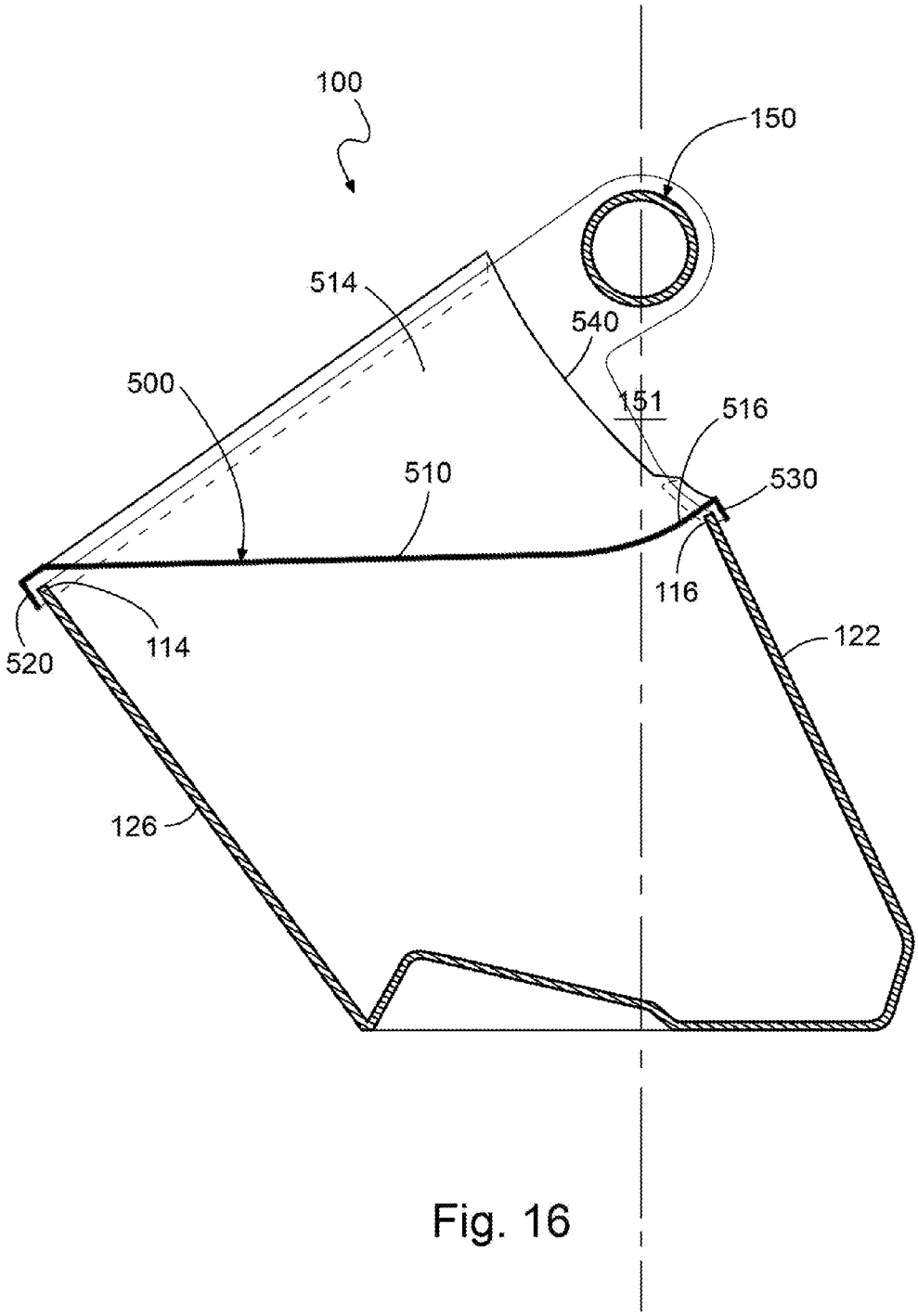
FIG. 16 is a side sectional view of the fluid container and lid of FIG. 15.
Figure 17:
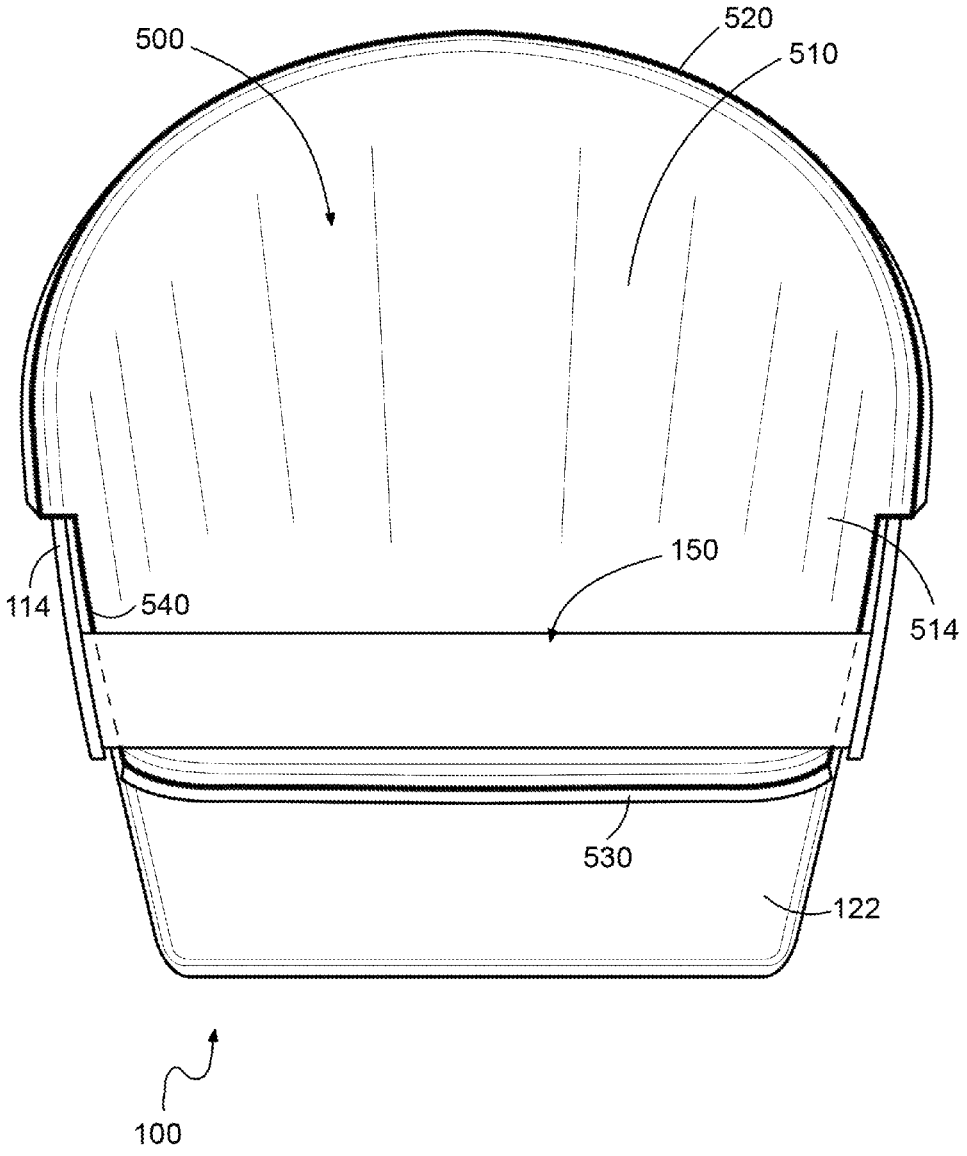
FIG. 17 is a top view of the fluid container and removable lid of FIG. 15.

FIGS. 15-17 illustrate a lid 500 designed and intended to mate with fluid container 100 to enclose container interior 101. Lid 500 is shaped to seat over the top edge 114 and rear wall edge 116 in snap fit or friction connection. Lid 500 is formed or molded of a plastic or elastomeric material. In certain embodiments, the lid is relatively rigid. In other embodiments, the lid 500 is pliable. Lid 500 has a recessed lid top 510, an arcuate peripheral front lip 520 and a straight rear lip 530. Front lip 520 and rear lip 530 are fashioned to seat over the top edge 114 of container wall 110 around the front of fluid container 110 and over top edge 116 of rear wall portion 122, respectively. Lip top 510 is concave to seat below the plane of top edge 114 of fluid container 100. Lip top 510 is also recessed at the rear of lid 500 to align with the top edge of rear wall portion 122. The walls of lip top 510 arc upward against the inside of container walls 110. Lid top 510 has edges 540 that transition downward form the end of front lip 520 to rear lip 530. The area 514 of lid top 510 around edge 540 conform and abut flatly against the inside of side wall portions 124. The press fit engagement of front lip 520 and rear lip 530 along with the abutment of the lid top area 514 against the inside of the container wall 110 allows lid 500 to enclose and seal container interior 101 while still allowing full access of handle 150 and handle opening 151.

One skilled in the art will note several advantages of the handheld fluid containers of this invention. The fluid containers provide improved container balance and ergonomics to reduced user stress and fatigue while improving functionality. The shape and configuration of the container bodies shift the center of gravity rearward toward the support hand as the container is filled with fluid to reduce the force exerted on the user's hand in supporting the containers. The shape and configuration of the container bodies and handles also help balance the containers. Regardless of whether the container is carried or resting on a horizontal surface, whether empty, fully filled or partially filled, the container's balance remains relatively stable, which prevents spills and provides consistent orientation of the container opening. The fluid container can be nested together for convenient storage and shelf display.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A handheld fluid container comprising:

a container body; and a handle part associated with the container body, the container body including a container bottom and a container wall extending around the container bottom to define a container interior with an open top for receiving fluid therein, the container wall having opposed sidewall portions, a front wall portion and a rear wall portion extending from the container bottom, the container bottom is substantially flat and coplanar with a first plane, the rear wall portion is substantially flat and coplanar with a second plane, the rear wall portion extends upward from and overlying the container bottom towards the front wall portion at a first angle with respect to the first plane, the rear wall portion has an inward facing surface and an outward facing surface, and terminates in a rear wall edge that is located between the container bottom and the top container edge, the front wall portion and sidewall portions terminating in a top container edge that is coplanar with a third plane, the front wall portion extends upward and outward from the container bottom at a second angle from the first plane, the handle part extends between the opposed sidewall portions over the container bottom between the first plane and the third plane and parallel to and rearward of the second plane, the handle part is spaced over the rear wall edge forming a handle opening therebetween for receiving a portion of a user's hand, the container body having a centroid located within the container interior and a separate center of gravity located between the centroid and the rear wall portion of the container when a fluid is disposed within the container interior so as to reduce the torque exerted on the user's hand when supporting the container with the portion of the user's hand extending through the handle opening.

2. The handheld fluid container of claim 1 wherein the front wall portion and the rear wall portion extend from the container bottom at an acute angle with respect to the first plane.

3. The handheld fluid container of claim 2 wherein the front wall portion and the rear wall portion both extend from the container bottom in the same direction.

4. The handheld fluid container of claim 1 wherein the first angle and the second angle are between 40 and 85 degrees.

5. The handheld fluid container of claim 1 wherein the first angle is greater than the second angle.

6. The handheld fluid container of claim 1 wherein the container bottom has a semielliptical shape.

7. The handheld fluid container of claim 1 wherein the container bottom has a trapezoidal shape.

8. The handheld fluid container of claim 1 wherein the rear wall portion is wider than the front wall portion.

9. The handheld fluid container of claim 1 wherein each of the opposed side wall portions has a protrusion extending therefrom and spaced rearward and above the rear wall portion, the handle part connected between the protrusion of each of the opposed side wall portions.

10. The handheld fluid container of claim 1 wherein the handle part has a hook shaped body extending rearward from the rear wall portion and is spaced from and over the rear wall portion.

11. The handheld fluid container of claim 10 wherein the handle part terminates in a looped end adapted to receive the thumb of a user for supporting the container body.

12. The handheld fluid container of claim 1 wherein the container body is adapted to nest inside the container interior of a second fluid container.

13. The handheld fluid container of claim 1 wherein the rear wall portion has a greater mass than the front wall portion.

14. The handheld fluid container of claim 1 and a detachable counterweight adapted to mount to the rear wall portion.

15. The handheld fluid container of claim 1 and a detachable lid adapted to enclose the container interior.

16. The handheld fluid container of claim 1 wherein the container bottom has a protrusion extending into the container interior adjacent the front wall portion.

* * * * *